United States Patent [19]

Kallianos et al.

[11] 4,163,453

[45] Aug. 7, 1979

[54] 7-ALKOXY-1,2-BENZOPYRONES AS TOBACCO FLAVORANTS

[75] Inventors: Andrew G. Kallianos, Durham, N.C.; Melvyn I. Simpson, Fargo, N. Dak.

[73] Assignee: Liggett Group Inc., Durham, N.C.

[21] Appl. No.: 731,382

[22] Filed: Oct. 12, 1976

[51] Int. Cl.[2] ..... A24B 3/12; A24B 15/04

[52] U.S. Cl. ..... 131/17 R; 131/15 R; 131/144

[58] Field of Search ..... 260/345.2; 426/354, 426/356; 131/2, 17, 15, 144

[56] References Cited

PUBLICATIONS

*Fenaroli's Handbook of Flavor Ingredients* published by The Chemical Rubber Co., Cleveland, Ohio, p. 346.

*Tobacco Flavoring for Smoking Products* by Leffingwell et al., publ. by R. J. Reynolds Tobacco Co. in 1972, Winston-Salem, N.C. (U.S.A), pp. 56, 57 and 63.

*Primary Examiner*—Robert W. Michell

*Assistant Examiner*—V. Millin

*Attorney, Agent, or Firm*—Michael L. Hendershot; J. Bowen Ross, Jr.

[57] ABSTRACT

A process for improving, enhancing or modifying the organoleptic properties of tobacco products which comprises adding thereto a compound possessing the following formula:

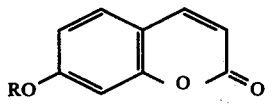

wherein R represents a straight or branched-chain alkyl, alkenyl or cyclic aliphatic or aromatic hydrocarbon group having less than 8 carbon atoms.

12 Claims, No Drawings

7-ALKOXY-1,2-BENZOPYRONES AS TOBACCO FLAVORANTS

The present invention relates to a tobacco product and has for an object the provision of a natural or synthetic tobacco composition having improved aroma and flavor.

It is well known, as far as the ultimate consumer is concerned, that flavor and aroma are perhaps the largest factors in his selection of a smokeable tobacco product. In the case of most smoking tobacco products manufactured today the desired flavor and aroma are achieved by the blending of domestic and oriental tobaccos each of which contributes its own characteristic aroma and flavor during smoking. However, the manufacturer may be restricted in achieving a desirable product because of limitations on the available types of tobacco with which he can work.

Accordingly, it is an object of the present invention to ameliorate the restrictive conditions inherent in blending by utilizing a new class of additive materials, which when applied to the tobacco or the tobacco product improves and enhances the flavor and aroma of the tobacco smoke emitted from these products thereby enhancing the pleasure derived by the consumer.

A further object of this invention is the provision of a process for enhancing or otherwise improving the flavor and aroma of certain domestic, oriental, reconstituted or synthetic tobaccos and blends thereof which may be deficient in said flavor or aroma.

An additional object of this invention is to provide a smoking product, such as cigarettes, cigars, or pipe tobacco, and a process for forming same whereby the flavor and aroma of the tobacco smoke are sweet, vanilla like, and similar to new or freshly mown hay in character and thus are enhanced during smoking.

Further and additional objects will appear from the following description and the appended claims.

In accordance with the practice of the present invention the flavor and aroma of tobacco smoke from a natural or synthetic tobacco composition is improved by adding to the tobacco a flavoring composition containing at least one compound of the benzo-1,2-pyrone family having the following formula:

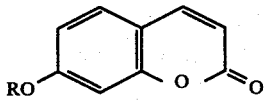

wherein R is a straight or branched chain alkyl or alkenyl group, having from 1 to 7 carbon atoms, preferably 1 or 2 carbon atoms, in the alkyl or alkenyl chain, such as methyl, ethyl, n-propyl, iso-propyl, n-butyl, hexyl, propenyl, and the like; or a cyclic aliphatic or aromatic hydrocarbon group, including the monocyclic and bicyclic groups, having less than 8 carbon atoms, such as cyclopentyl, cyclohexyl, bicyclo-[2.2.1]-heptyl, phenyl, benzyl, and the like. Preferably R in the above formula is methyl, i.e., the preferred compound would be 7-methoxy-1,2-benzopyrone.

The compounds of this invention can be readily prepared by known techniques. The most convenient technique is to treat umbelliferone (7-hydroxy-1,2-benzopyrone) with an alkylating agent in refluxing acetone in the presence of potassium carbonate. Alternatively, these compounds can be prepared by condensation of the appropriate mono-o-alkyl substituted resorcinol and malic acid, either optically active or racemate, in the presence of sulfuric acid. It will be readily apparent to those experienced in the art that these methods of preparation are intended only to be illustrative and not exclusive and that the products may be obtained by other methods, both chemical and catalytic.

In the practice of the present invention a compound or a mixture of compounds having the above structural formula is added to tobacco, both natural and synthetic, or applied to a tobacco product or its component parts to modify or enhance the flavor thereof. The compounds of the present invention are especially useful as flavorants for cigarette tobacco. The quantity of flavorant employed is not narrowly critical and can vary over a wide range. Normally the flavorant is added in an amount to give a final concentration of from about 0.0001 to about 0.1 weight percent, preferably from about 0.001 to about 0.01 weight percent, based on the weight of the tobacco or the tobacco product. However, the amount used will depend upon the amount of particular type of flavor desired and the particular compound or mixture thereof that is used.

The flavoring agents of the present invention may be incorporated at any step in the processing of tobacco. They may be applied to the individual tobacco blend components, such as the natural tobaccos, reconstituted tobacco sheet, or tobacco substitutes of natural or synthetic origin. Preferably the additive is added after aging, curing and shredding and before the tobacco is formed into cigarettes.

Furthermore, the flavoring agents of this invention may be blended with the tobacco in any convenient manner. For example, they can be dissolved in ethanol, acetone or any other suitable solvents, or admixed with a carrier such as casing solution to form a suspension or dispersion, and the resulting combination sprayed, dipped or otherwise applied on the tobacco. Thus water or volatile organic solvents, such as alcohol; glycols, for instance propylene glycol; ether; volatile hydrocarbons; mixtures thereof and the like, may be used as the carrier medium for the agent while it is applied to the tobacco. Alternatively, the agent or mixtures thereof can be blended with other additives and then mixed into the tobacco. Thus it can be incorporated into blends normally employed to product reconstituted tobacco sheet or tobacco substitutes of natural or synthetic origin. Inasmuch as the flavoring agents of this invention are somewhat volatile, they may also be incorporated into the filter tip, the seam paste employed for gluing the cigarette paper or the packaging material.

While this invention is principally useful in the manufacture of cigarette tobacco, it is also suitable for use in connection with the manufacture of pipe tobacco, cigars or other tobacco products. The term "tobacco" as used throughout this specification is intended to mean any composition intended for use by smoking or otherwise, whether composed of tobacco plant parts or substitute materials or both.

The following examples are merely illustrative and are not presented as a definition of the limits of the invention. Where the concentration of the additive is given in units of ppm, it has been calculated on a weight basis.

EXAMPLE 1

7-Methoxy-1,2-benzopyrone

To a solution of 15 grams (g) 7-hydroxy-1,2-benzopyrone and 20 g dimethylsulfate in 150 ml anhydrous acetone was added 35 g potassium carbonate. The resulting suspension was heated under reflux for 24–30 hours, cooled to room temperature and poured into an excess of water. The solid which precipitated was collected by filtration and recrystallized from hot acetone to give 7-methoxy-1,2-benzopyrone, mp 117°–118° C.

The structure of the product was confirmed by the following spectroscopic data:

Infrared ($CCl_4$): 1741, 1615, 1121 $cm^{-1}$

Proton Magnetic Resonance: deuterated chloroform ($CDCl_3$):

3.89 (s, 3H)—$OCH_3$
6.27 (d, 1H, J=10Hz)=CH
6.8–7.0 (m, 2H) aromatic
7.4 (d, 1H, J=9.5 Hz)
7.65 (d, 1H, J=9.5 Hz)

Mass Spectrum: M+ 176, 148, 133, 105

The aroma of the 7-methoxy-1,2-benzopyrone compound prepared above, bears a strong resemblance to that of coumarin, i.e., sweet, vanilla like and similar to new mown hay in character.

An ethanolic solution of the compound prepared as described in this Example was applied to a commercial blend of cigarette tobaccos in an amount sufficient to provide tobacco containing approximately 0.005 percent by weight of the additive on a dry basis. The tobacco was then manufactured into cigarettes by the usual techniques. Upon flavor evaluation, a panel of experts found the cigarette smoke to possess an enhanced tobacco character with a distinctive hay-like sweet note. The sidestream aroma was also greatly improved compared to a control cigarette.

EXAMPLE 2

7-Ethoxy-1,2-benzopyrone

To a solution of 5 g 7-hydroxy-1,2-benzopyrone and 4.8 g ethyl iodide in 100 ml anhydrous acetone was added 4.5 g $K_2CO_3$. The resulting suspension was heated under reflux for two days and then cooled to room temperature. The solids were filtered off and the filtrate concentrated to give 7.7 g of a yellow solid. The solid was suspended in 50 ml $H_2O$ and the insoluble material filtered off and air-dried. Recrystallization from hot acetone gave 7-ethoxy-1,2-benzopyrone, mp 87° C.

The structure of the product was confirmed by the following spectroscopic data:

Infrared ($CCl_4$): 1722, 1610, 1125 $cm^{-1}$

Proton Magnetic Resonance ($CDCl_3$):

1.4 (t, 3H, J=7 Hz)
4.0 (q, 2H, J=7 Hz)
6.15 (d, 1H, J=9 Hz)
6.7–7.7 (m, 4H)

Mass Spectrum: M+ 190 (100), 134 (86), 162 (42)

The aroma of the compound prepared as described in this Example has been described as spicey and floral in character. Upon application of this compound to a commercial blend of cigarette tobaccos by the same method and procedure described in Example I, at a level of 50 parts per million (ppm), a panel of experts described the taste of the smoke as being cocoa-sweet with a slight increase in irritation.

EXAMPLE 3

7-n-Butoxy-1,2-benzopyrone

To a solution of 5 g 7-hydroxy-1,2-benzopyrone and 4.3 g 1-bromobutane in 100 ml of anhydrous acetone was added 4.5 g $K_2CO_3$. The resulting suspension was heated under reflux for two days and then cooled to room temperature. The solids were filtered off and the filtrate concentrated to give 6.7 g of a viscous oil. The oil was distilled at reduced pressure to give 7-n-butoxy-1,2-benzopyrone as a colorless liquid, bp 150°–160°/1.4 mm. On standing the distillate solidified, mp 35° C.

The structure of the product was confirmed by the following spectroscopic data:

Infrared ($CCl_4$): 1725, 1610, 1120 $cm^{-1}$

Proton Magnetic Resonance ($CDCl_3$)

0.8–2.0 (broad, 7H)
4.0 (t, 2H, J=6.5 Hz)
6.15 (d, 1H, J=9 Hz)
7.6 (d, 1H, J=9 Hz)
6.65–7.4 (m, 3H)

Mass Spectrum: M+ 218 (45), 162 (100), 134 (66)

The aroma of 7-n-butoxy-1,2-benzopyrone is described as being medicinal and pungent with a sweet oily character. When applied by the same method and procedure described in Example I, at a level of 15 ppm, a panel of experts described the cigarette as leaving an oily coating in the mouth but with no readily discerned flavor characteristics.

EXAMPLE 4

7-isobutoxy-1,2-benzopyrone

To a solution of 5 g 7-hydroxy-1,2-benzopyrone and 3.95 g 1-bromo-2-methylpropane in 100 ml anhydrous acetone was added 4.3 g $K_2CO_3$. The resulting suspension was heated under reflux for 24 hr and then cooled to room temperature and filtered. The filtrate was concentrated at reduced pressure to leave a bright yellow solid. The solid was treated with 100 ml ether and the insoluble material removed by filtration. The filtrate was washed with saturated aqueous sodium bicarbonate, dried over $Na_2SO_4$, filtered and concentrated at reduced pressure to leave a white solid. Recrystallization from methanol gave 7-isobutoxy-1,2-benzopyrone as white needles, mp 80°.

The structure of the product was confirmed by the following spectroscopic data:

Infrared ($CCl_4$): 1745, 1615, 1122 $cm^{-1}$

Mass Spectrum: M+ 218 (34), 176 (24), 162 (100), 134 (62), 133 (17)

The aroma of 7-isobutoxy-1,2-benzopyrone, as prepared above, has been described as a low intensity medicinal odor. A panel of experts evaluated this compound in cigarettes by the same method and procedure used in Example I, at a level of 50 ppm, and found the smoke had a waxy, sweet-sour taste with decreased tobacco taste.

EXAMPLE 5

7-n-hexoxy-1,2-benzopyrone

To a solution of 5 g 7-hydroxy-1,2-benzopyrone and 5.1 g 1-bromohexane in 100 ml anhydrous acetone was added 4.3 g $K_2CO_3$. The resulting suspension was heated under reflux for two days and then cooled to room temperature and filtered. The filtrate was concentrated at reduced pressure and the residue taken up in ether and washed with saturated aqueous sodium bicarbonate. The organic layer was dried over $Na_2SO_4$ and the solvent removed at reduced pressure to leave a viscous oil.

The structure of the product was confirmed by the following spectroscopic data:

Infrared ($CCl_4$): 1745, 1615, 1122 $cm^{-1}$

Mass Spectrum: M+ 246 (21), 176 (44), 162 (100), 148 (36), 134 (47), 133 (35)

The aroma of the 7-hexoxy-1,2-benzopyrone compound, prepared above, resembles the odor associated with hospital corridors, but at a low level of intensity. When evaluated in cigarettes, by the same method as described in Example I, at 50 ppm, a panel of experts found that initially there was a maple-sweet note which later became spicy.

It should be appreciated that in the art of flavor blending a variety of effects are possible from a flavorant depending on the amounts of flavorant used and the nature of the substrate. Therefore, the present invention contemplates the blending of the claimed compounds with other flavorants and the application of these flavor mixtures to a variety of tobacco substrates, both synthetic and natural tobaccos. The amount of the claimed compounds to be blended with the other flavorants is of course optional depending on the particular effect one is trying to achieve and the type tobacco or tobaccos to which the mixture is added.

It will be appreciated that while several embodiments of this invention are shown above, the invention is not to be limited thereto, since many modifications can be made by those skilled in the art without departing from the spirit and scope of the invention as set forth in the appended claims.

What is claimed is:

1. A method for improving the flavors of a smoking tobacco which comprises adding thereto, in an amount of from about 0.0001 to about 0.1 percent by weight of the tobacco, at least one compound having the following formula:

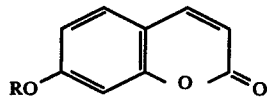

wherein R is selected from the group of straight or branched chain alkyl or alkenyl groups, having from 1 to 7 carbon atoms in the alkyl or alkenyl chain; or a cyclic aliphatic or aromatic hydrocarbon group having less than 8 carbon atoms.

2. The method of claim 1 wherein the amount of the compound added to the tobacco is from about 0.001 to about 0.01 percent by weight of the tobacco.

3. The method of claim 1 wherein R is a straight or branched chain alkyl group, having from 1 to 7 carbon atoms in the alkyl chain.

4. The process of claim 3 wherein R is methyl.

5. The process of claim 3 wherein R is ethyl.

6. The process of claim 3 wherein R is n-butyl.

7. The process of claim 3 wherein R is iso-butyl.

8. The process of claim 3 wherein R is n-hexyl.

9. A tobacco or smoking tobacco product having added thereto about 0.0001 to about 0.1 weight percent, based on the weight of the tobacco, of at least one compound having the formula:

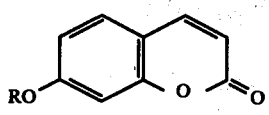

wherein R is selected from the group of straight or branched chain alkyl or alkenyl groups, having from 1 to 7 carbon atoms in the alkyl or alkenyl chain or a cyclic aliphatic or aromatic hydrocarbon group having less than 8 carbon atoms.

10. The product of claim 9 wherein R is an alkyl group having from 1 to 7 carbon atoms in the alkyl chain.

11. The product of claim 10 wherein R is selected from the group consisting of methyl, ethyl, n-butyl, isobutyl and n-hexyl.

12. The product of claim 11 wherein R is methyl.

* * * * *